US007014503B1

(12) United States Patent
Wang

(10) Patent No.: US 7,014,503 B1
(45) Date of Patent: Mar. 21, 2006

(54) MULTIPLE PIECES DUAL TYPE BNC CONNECTOR

(75) Inventor: Shung-Ping Wang, Hsin-Tien (TW)

(73) Assignee: Insert Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 11/017,806

(22) Filed: Dec. 22, 2004

(51) Int. Cl.
*H01R 9/05* (2006.01)

(52) U.S. Cl. ..... 439/581; 439/541.5

(58) Field of Classification Search ..... 439/581, 439/541.5, 63
See application file for complete search history.

(56) References Cited

U.S. PATENT DOCUMENTS 5,613,880 A * 3/1997 Wang ..... 439/620
6,837,742 B1 * 1/2005 Chou et al. ..... 439/541.5

* cited by examiner

*Primary Examiner*—Ross Gushi
(74) *Attorney, Agent, or Firm*—Troxell Law Office, PLLC

(57) ABSTRACT

A multiple pieces dual type BNC connector comprises an insulating rear section casing and a plurality of insulating front section casings, the rear section casing has a accepting room corresponding to an accepting room of each front section casing, the accepting room of the rear section casing and the accepting room of the front casing are respectively combined with a first engaging section and second engaging section with a metal shell. Each metal accepting room is connected with an insulator and the insulator is combined with a BNC terminal so as to form a structure with one set of dual type BNC connectors.

11 Claims, 11 Drawing Sheets

MULTIPLE PIECES DUAL TYPE BNC CONNECTOR

BACKGROUND OF THE INVENTION

1. Field of the Invention

The present invention relates to a dual type BNC connector, and more particularly to a dual type BNC connector with an insulating shell.

2. Description of Related Art

U.S. Pat. No. 5,730,621 entitled "Dual-jack electrical connector" is granted to the applicant of the present invention. As FIGS. 1A and 1B show, a dual type BNC connector disclosed in the patent comprises a casing 11 made by a mold injection from a insulating material, two BNC plugs 12 axially parallel to each other, wave filtering apparatus used for filtering noises in electric signals installed on the casing 11 and consisted of a capacitor 13, conductive element 14 and nail 15 and an inserting element 16 used for assembling the casing 11 on a printing circuit board installed on the casing 11, in which The BNC plug includes a metal shell 121 being combined with a insulator 122 and BNC terminal 123 and a electric lead wire 124 at the rear end of the BNC terminal is extended our to the casing 11; it is characterized in that the two BNC plugs 12 mentioned above are mutually assembled at the casing 11 and formed as a dual type BNC connector mutually assembled on the printing circuit board through the casing 11.

The dual type connector mentioned above has a one piece type insulating casing. As FIG. 2 shows, when a one piece type insulating casing 17 is combined with two sets or more dual type BNC plugs 18, it is very difficult to manufacture by means of mold injection. For manufacturing an insulating casing with two sets or more dual type BNC connectors easier and manufacturing it in mass production so as to save the cost, the present invention is proposed.

SUMMARY OF THE INVENTION

The main object of the present invention is to provide a multiple pieces dual type BNC connector, allowing the manufacturing of an insulating casing of two sets or more dual type BNC connectors to be more practical and able to manufacture in mass production to save the production cost.

For attaining to the object mentioned above, a multiple pieces dual type BNC connector comprises an insulating rear section casing and a plurality of insulating front section casings, the rear section casing has a accepting room corresponding to an accepting room of each front section casing, the accepting room of the rear section casing and the accepting room of the front casing are respectively combined with a first engaging section and second engaging section with a metal shell. Each metal accepting room is connected with an insulator and the insulator is combined with a BNC terminal so as to form a structure with one set of dual type BNC connectors.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1B:
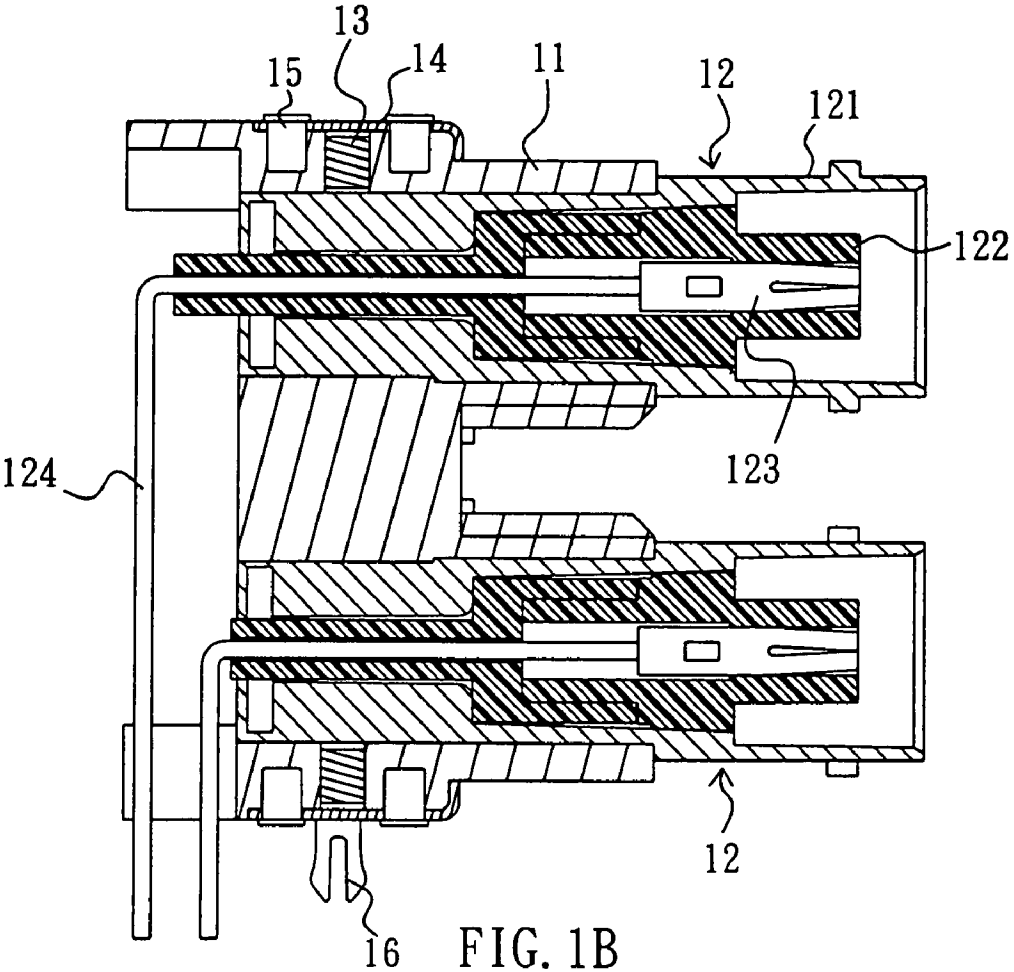
FIG. 1B (PRIOR ART)
FIGS. 1A and 1B respectively are prospective and cross sectional views, showing a dual type BNC connector with an insulating shell of the prior art.
Figure 1A:
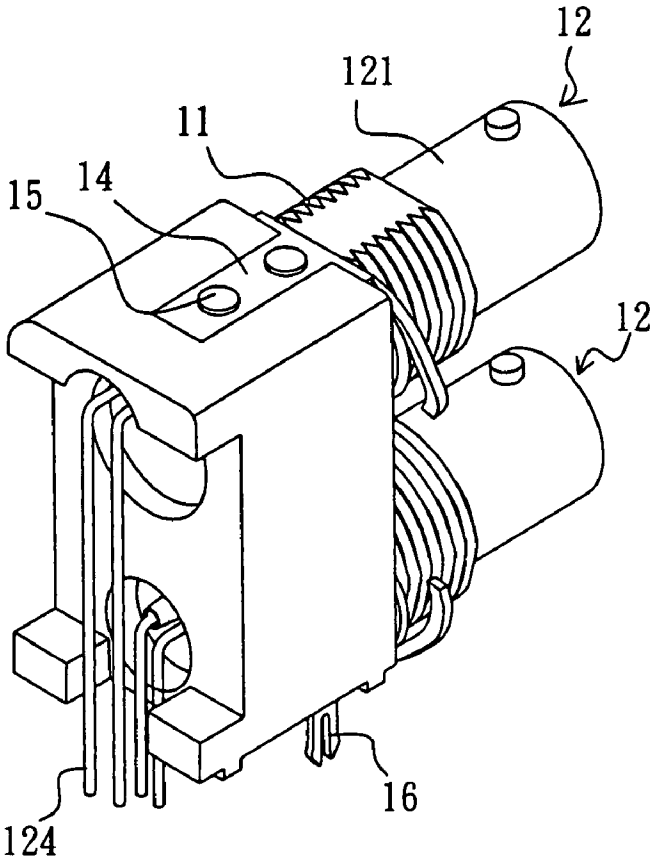
FIG. 1A (PRIOR ART)
Figure 3A:
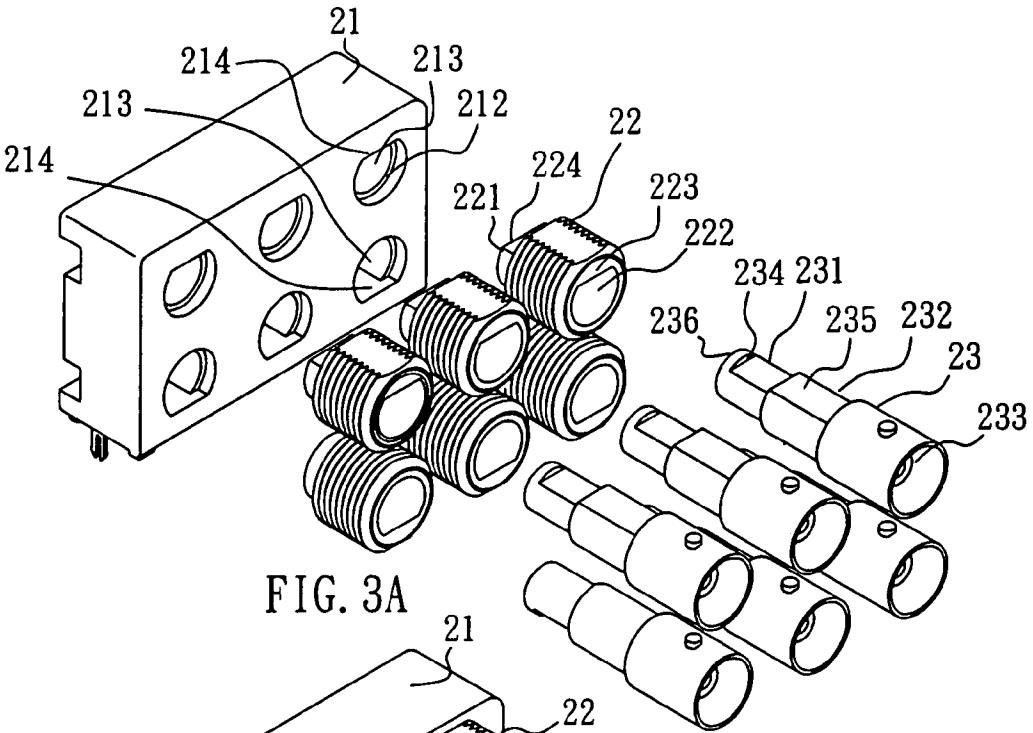
FIGS. 3A to 3D respectively are explosive, prospective, cross sectional and explosive, and cross sectional after combination views, showing a multiple pieces dual type BNC connector of a first preferred embodiment according to the present invention.
Figure 3B:
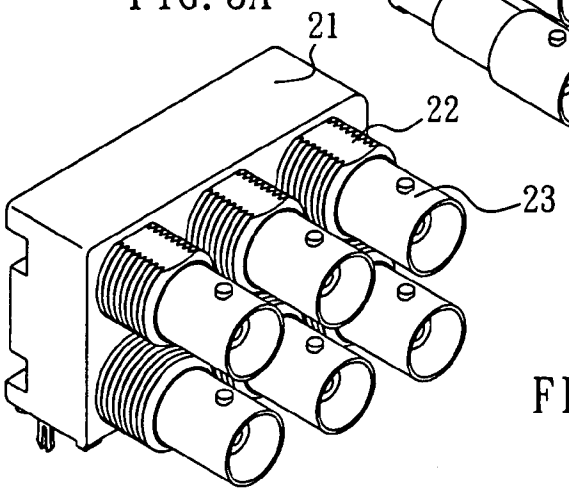
Figure 2:
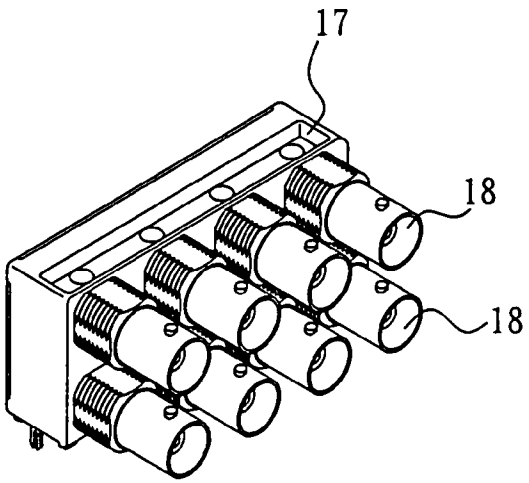
FIG. 2 (PRIOR ART)
FIG. 2 is a prospective view, showing connector with four sets of dual BNC connectors of the prior art.
Figure 3C:
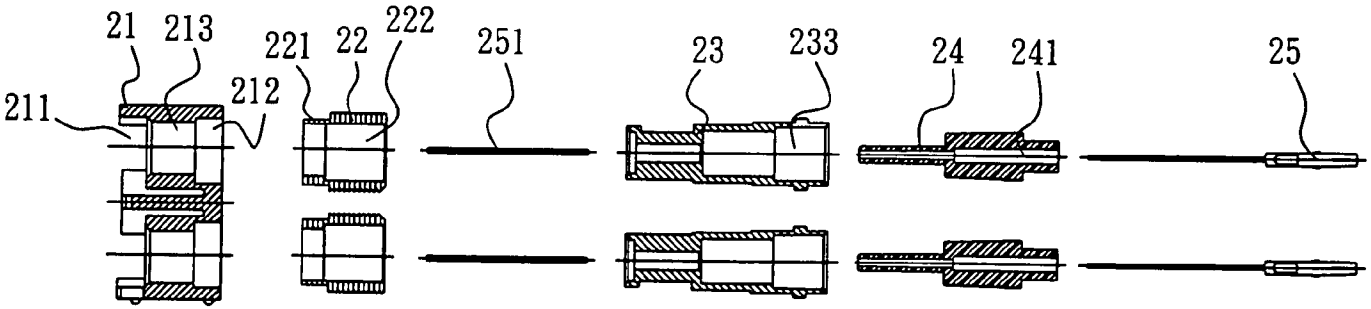
Figure 3D:
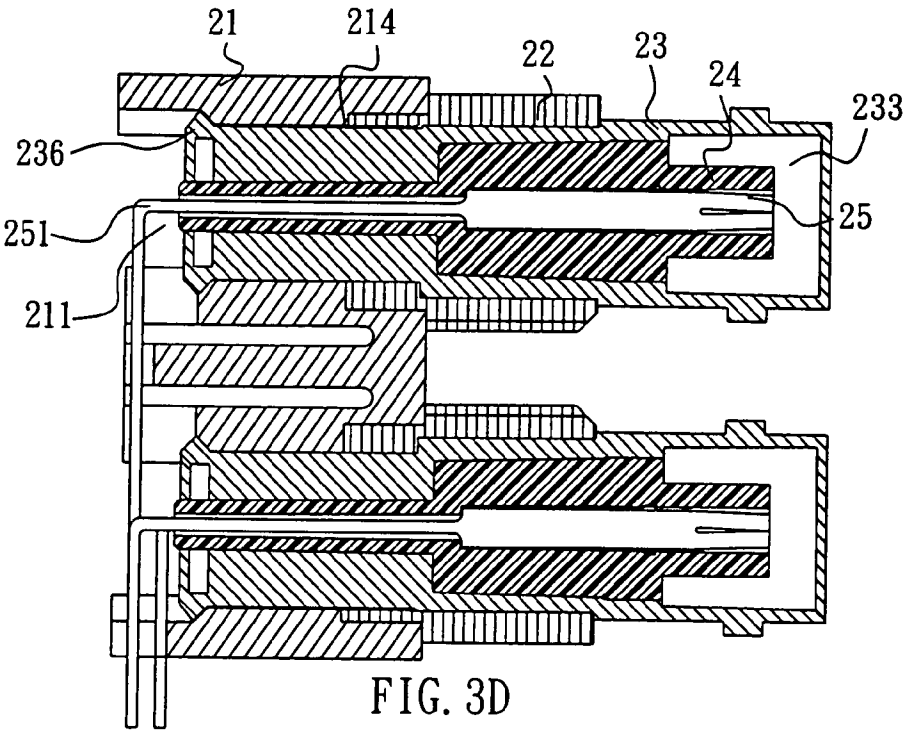
Figure 4A:
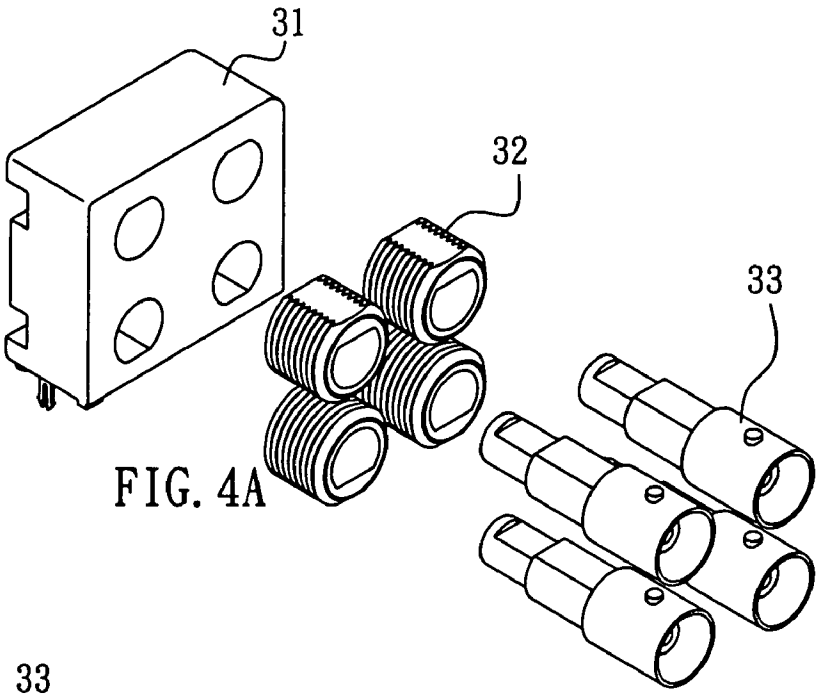
FIGS. 4A to 4D respectively are explosive, prospective, cross sectional and explosive, and cross sectional after combination views, showing a multiple pieces dual type BNC connector of a second preferred embodiment according to the present invention.
Figure 4B:
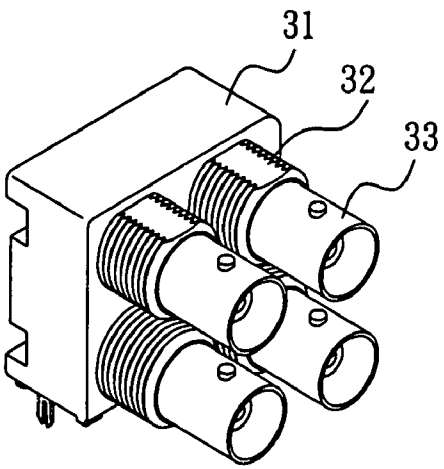
Figure 4C:
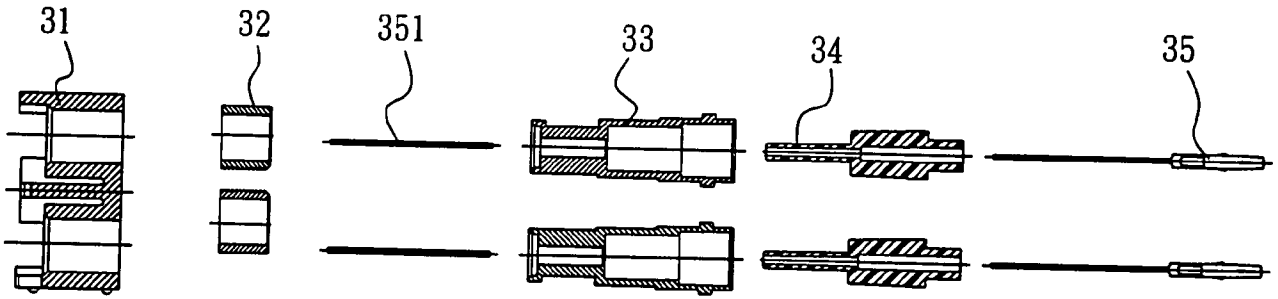
Figure 4D:
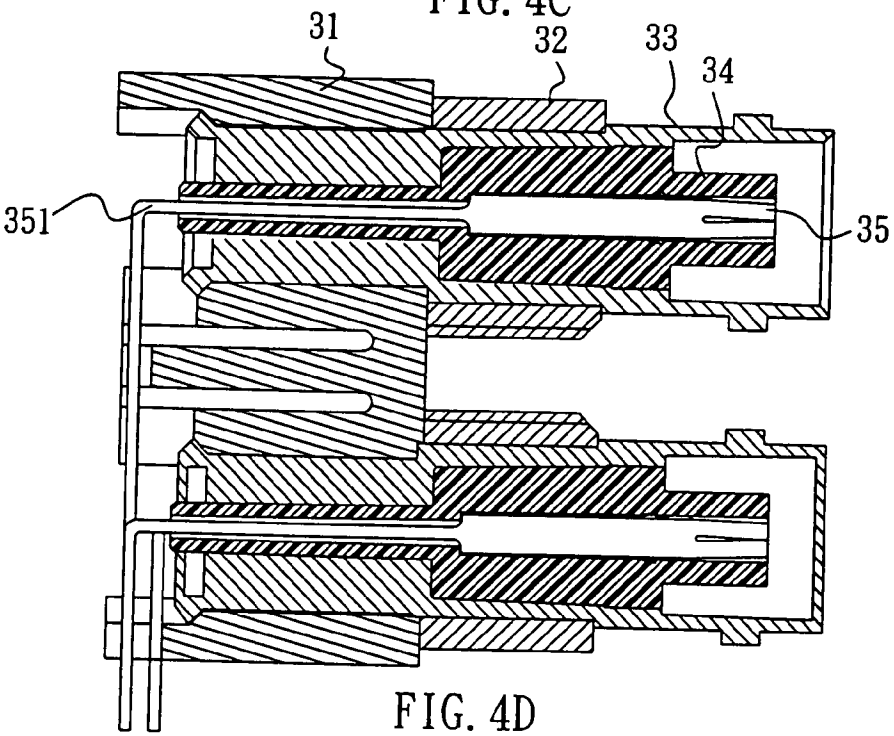
Figure 5A:
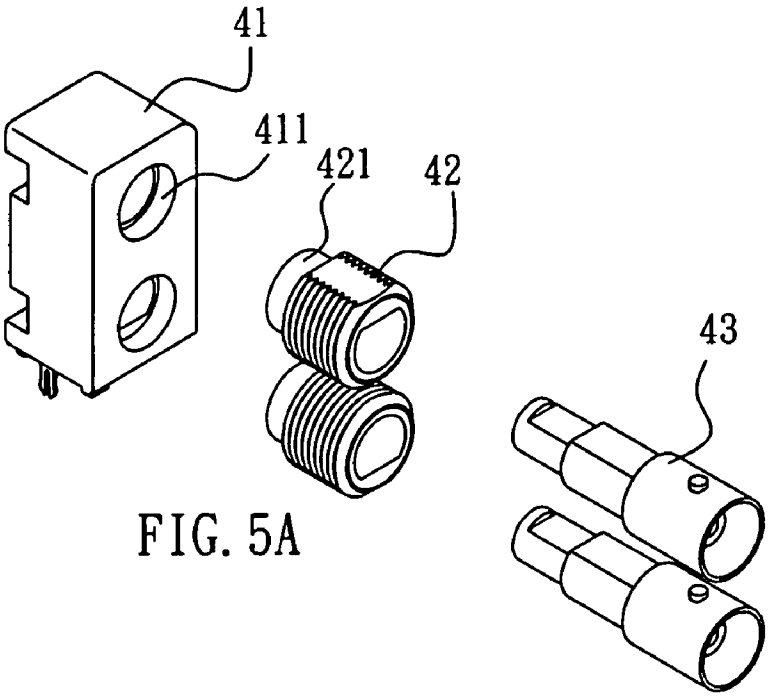
FIGS. 5A to 5D respectively are explosive, prospective, cross sectional and explosive, and cross sectional after combination views, showing a multiple pieces dual type BNC connector of a third preferred embodiment according to the present invention.
Figure 5B:
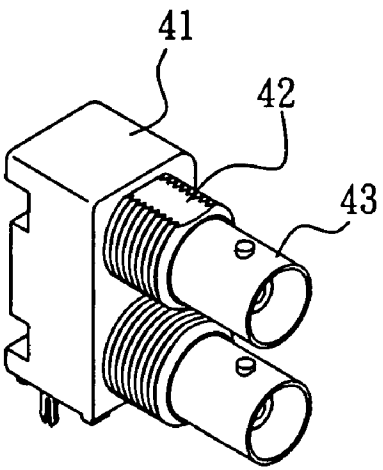
Figure 5C:
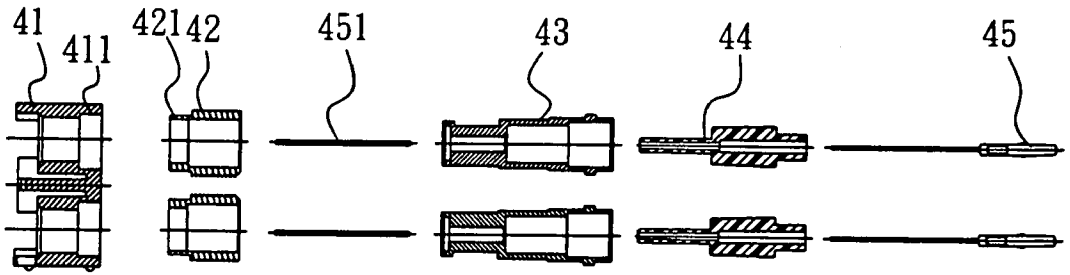
Figure 5D:
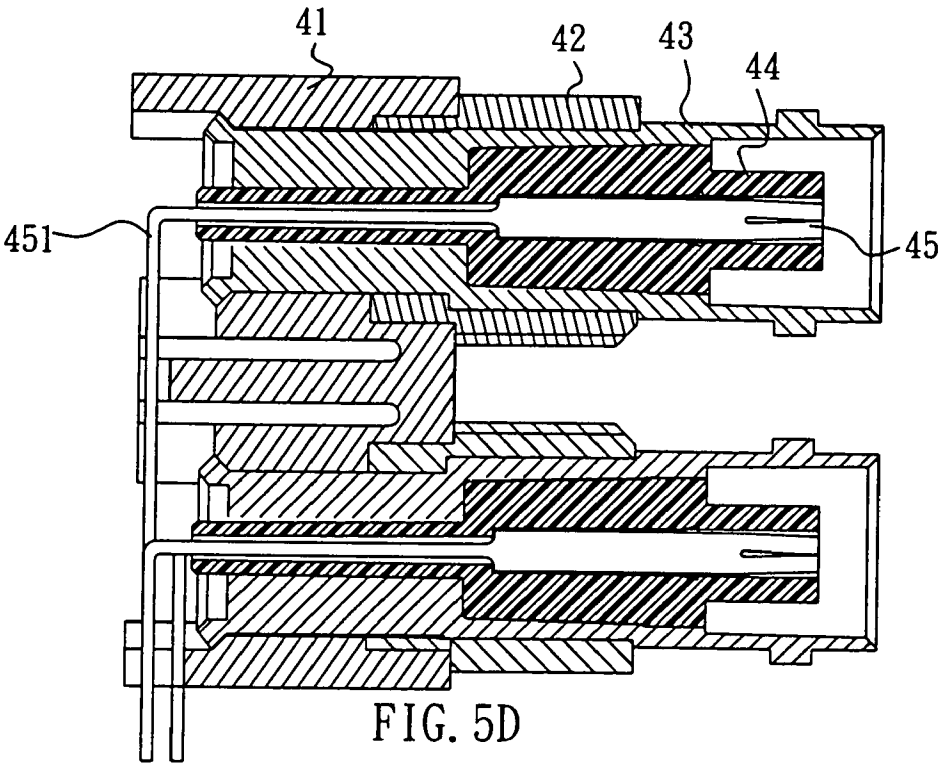
Figure 6A:
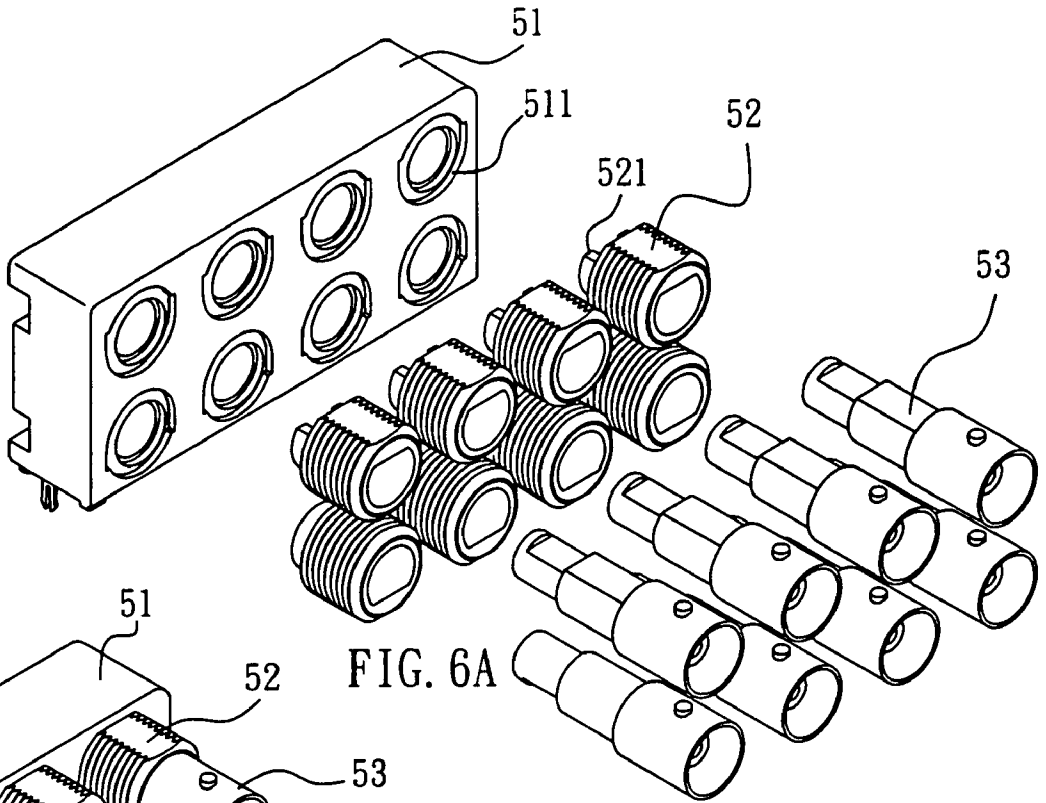
FIGS. 6A to 6D respectively are explosive, prospective, cross sectional and explosive, and cross sectional after combination views, showing a multiple pieces dual type BNC connector of a fourth preferred embodiment according to the present invention.
Figure 6B:
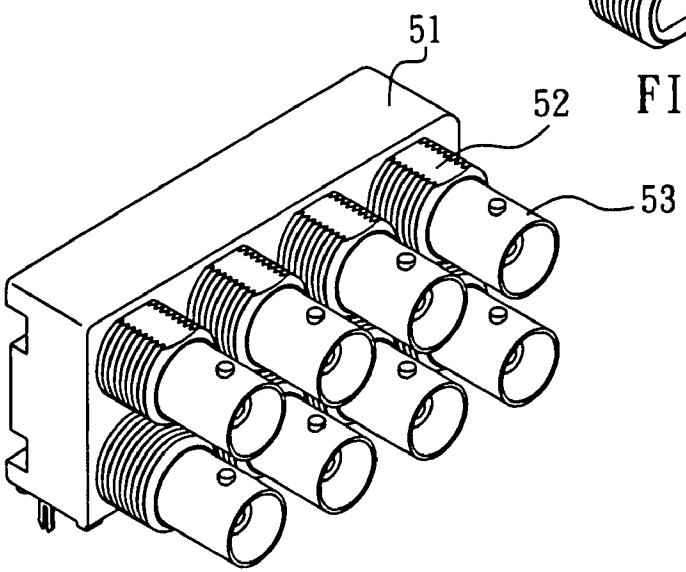
Figure 6C:
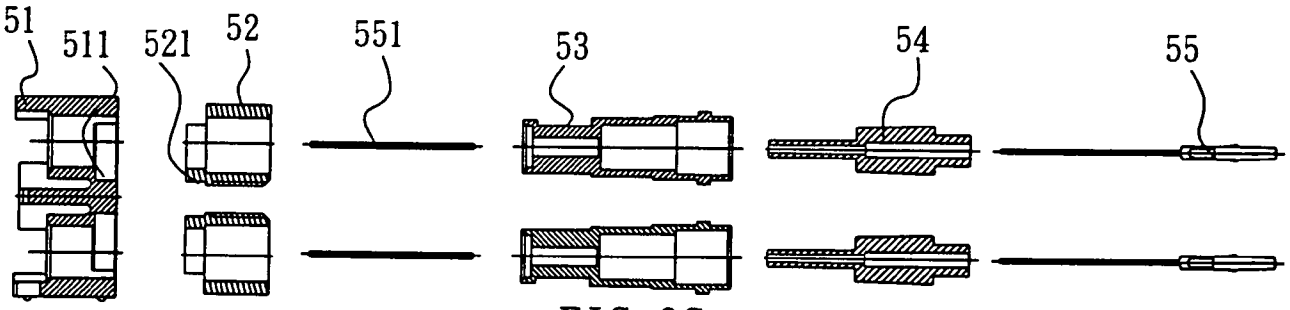
Figure 6D:
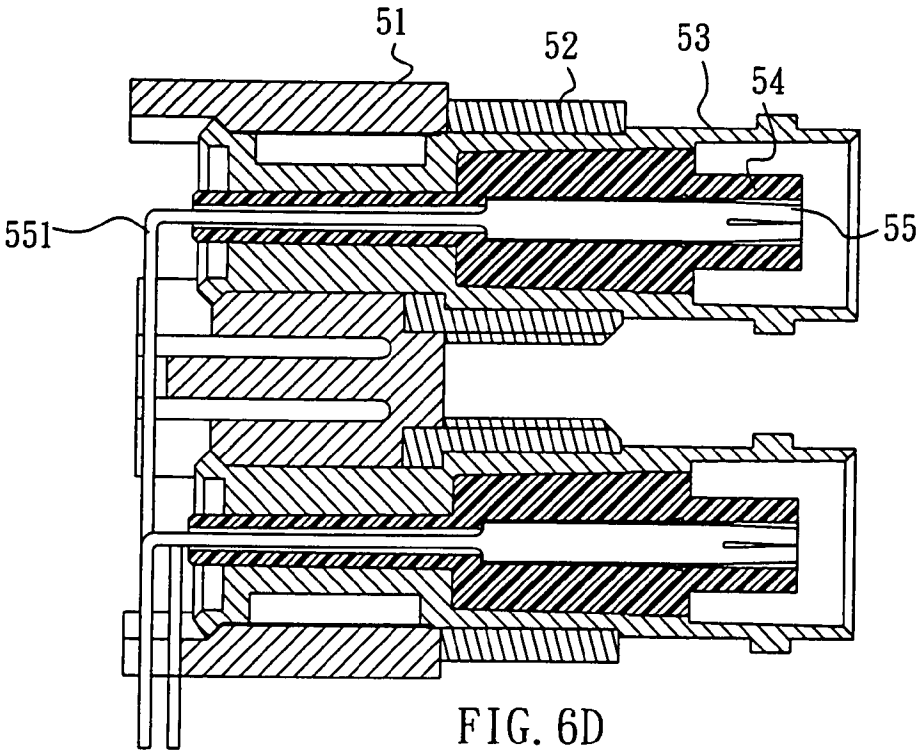

Please refer to FIGS. 3A to 3D. The difference between a multiple-pieces dual type BNC connector of a first preferred embodiment according to the present invention and one-piece type BNC connector with an insulating shell mainly is: separating a one-piece type insulating shell 11 into a rear section casing 21, a plurality of front section casings 22, and a metal shell 23 is allowed to have a structure respectively combined with the rear section casing 21 and the front section casings 22. Because the rear section 21 and the front section casings 22 can be manufactured individually and then combined into a whole body of metal shell, the manufacturing of two sets or more than two sets of dual type BNC connectors is more practicable, and because every component is capable of mass production, the production cost can be reduced.

A rear accepting room 211 is disposed at the rear end of the rear section casing 21 and a plurality of circular engaging grooves 212 are disposed at the front end thereof. An accepting room 231 passed through the front and rear ends of the rear section casing 21 are disposed within the range of each engaging groove 212. A cut plane 214 for connecting is disposed in the engaging groove 212 and the accepting room 213.

An engaging section 221 is disposed at the rear end of the front section casing 22 and an accepting room 222 is passed through the front and rear ends thereof. A cut plane 223 is disposed in the accepting room 222. A cut plane 224 corresponding to the cut plane 214 of the engaging groove 212 is disposed at the engaging section 221. The engaging section 221 is engaged in the engaging groove 212 to allow the rear section casing 21 to be combined with the front section casing 22. Because the two cut planes 214 and 224 are propped against each other, this causes the rear section casing 21 and the front section casing 22 not to rotate relatively.

The rear end of the metal shell 23 has a circular first engaging section 231 and circular second engaging section 232 and an accepting room 233 passed through the front and the rear ends, cut planes 234 and 235 respectively corresponding to the cut plane 214 in the accepting room 213 of the rear section casing 21 and the cut plane 223 in the accepting room 222 of the front section casing 22 are respectively disposed on the first engaging section 231 and the second engaging section 232. The two engaging sections 231 and 232 are respectively engaged in the accepting rooms 213 and 222 to cause the rear section casing 21 and the front section casing 22 to be combined with the metal shell 23, and a relative rotation is not yielded among three of them. The rear end of the cut plane 234 on the first engaging section 231 has a flange 236, the flange 236 is buckled outside of the rear end of the accepting room 213 to cause the metal shell 23 to be combined with the rear section casing 21 stably so as to form a structure with at least one set of dual type BNC connectors. The rear section casing 21 of the embodiment is combined with three sets dual BNC connectors, the cut planes 214 of the two accepting rooms 213 of each dual type BNC connectors are disposed in reserve.

A plurality of insulators 24 respectively have an accepting room 241 passed through the both ends at each of them so as to associate with a BNC terminal 25. A thrusting and compelling tightening way is used to cause the insulator 24 to be placed in an accepting room 233 of the metal shell 23 so that the rear sear casing 21, the middle section casings 22, the front end sections 23, the insulator 24 and the BNC terminal 25 are combined into one body and the BNC terminal 25 is not allowed to contact with the metal shell 23. Electric lead wires 251 at the rear end of each BNC terminal 25 are located in the rear accepting room 211 of the rear section casing 21 and bent to extend out of one side of the rear section casing 21.

Please refer to FIGS. 4A to 4D. A multiple pieces type dual type BNC connector with all metal shell of a second preferred embodiment according to the present invention also comprises a rear section casing 31, front section casing 32, metal shell 33, insulator 34, BNC terminal 35 and electric lead wire 351. The rear section casing 31 is combined with two sets of dual type BNC connectors, and except that the rear section casing 31 has no engaging groove and that the front section casing 32 has no engaging section are respectively different from the rear section casing 21 and the front section casing 22 of the first preferred embodiment shown in FIGS. 3A and 3B, other elements are approximately same. The rear section casing 31 in the structure of the present embodiment is also allowed to combine with the front section casing 32 and the metal shell 33, and no relative rotation is yielded among three of them.

Please refer to FIGS. 5A to 5D. A multiple pieces type dual type BNC connector with all metal shell of a third preferred embodiment according to the present invention also comprises a rear section casing 41, front section casing 42, metal shell 43, insulator 44, BNC terminal 45 and electric lead wire 451. The rear section casing 41 is combined with one sets of dual type BNC connectors, and except that an engaging groove 411 of the rear section casing 41 and an engaging section 421 of the front section casing 42 respectively have no cut planes is different from the rear section casing 21 and the front section casing 22 of the first preferred embodiment shown in FIGS. 3A and 3B, other elements are approximately same. The rear section casing 41 in the structure of the present embodiment is also allowed to combine with the front section casing 42 and the metal shell 43, and no relative rotation is yielded among three of them.

Please refer to FIGS. 6A to 6D. A multiple pieces type dual type BNC connector with all metal shell of a fourth preferred embodiment according to the present invention also comprises a rear section casing 51, front section casing 52, metal shell 53, insulator 54, BNC terminal 55 and electric lead wire 551. The rear section casing 51 is combined with four sets of dual type BNC connectors, and except that an engaging groove 511 of the rear section casing 51 and an engaging section 521 of the front section casing 52 are respectively formed to be corresponding arc shapes is different from the rear section casing 21 and the front section casing 22 of the first preferred embodiment shown in FIGS. 3A and 3B, other elements are approximately same. The rear section casing 51 in the structure of the present embodiment is also allowed to combine with the front section casing 52 and the metal shell 53. and no relative rotation is yielded among three of them.

Figure 7A:
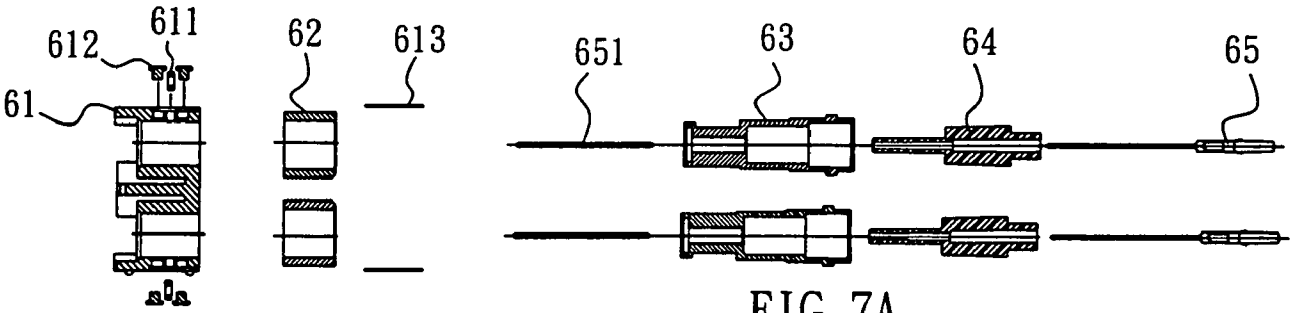
FIGS. 7A to 7B respectively are explosive and cross sectional after combination views, showing a multiple pieces dual type BNC connector of a fifth preferred embodiment according to the present invention.
Figure 7B:
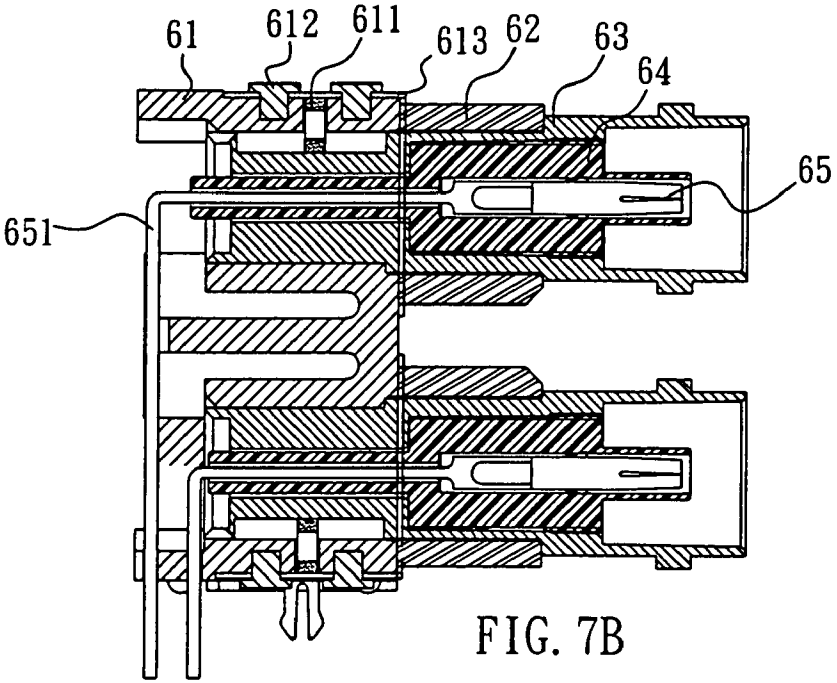
Figure 8:
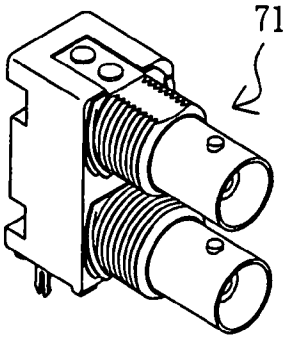
FIGS. 8 to 11 are prospective views, respectively showing a multiple pieces dual type BNC connectors of sixth to ninth preferred embodiments according to the present invention.
Figure 9:
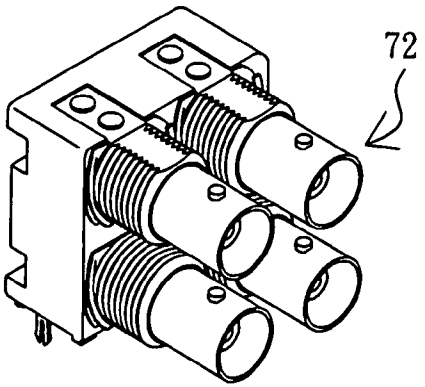
Figure 10:
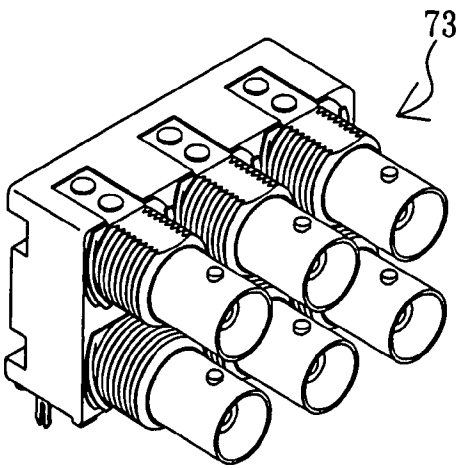
Figure 11:
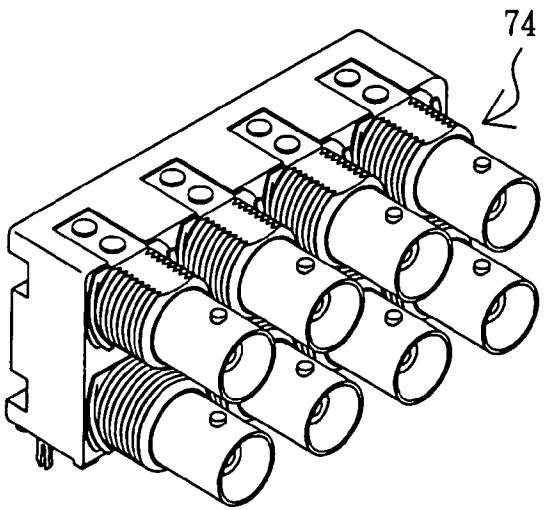

Please refer to FIGS. 7A and 7B. A multiple pieces type dual type BNC connector with all metal shell of a fifth preferred embodiment according to the present invention also comprises a rear section casing 61, front section casing 62, metal shell 63, insulator 64, BNC terminal 65 and electric lead wire 651. The main difference between the present embodiment and the second embodiment shown in FIGS. 4C and 4D lies in that the wall of the rear section casing 61 has a hole and groove respectively accepting a capacitor 611 and nail 612, a conductive element 613 is fixed at the outside of the capacitor 611 with the nail 612, the two ends of the capacitor 611 are respectively electrically connected to the metal shell 63 and the conductive element 613. A wave filtering apparatus constituted by the capacitor 611, the conductive element 613 and the nail 612 is installed at the rear section casing 61 for filtering noises in electric signals.

Please refer to FIGS. 8 to 11. rear section casings 71, 72, 73 and 74 of multiple pieces type dual type BNC connectors with all metal shell of sixth to ninth preferred embodiments according to the present invention are respectively combined with one to four sets of dual type BNC connectors, and the rear section casings 71, 72, 73 and 74 are respectively same as the rear section casing of the fifth embodiment, a filtering apparatus is installed in each of them for filtering noises in electric signals.

Each preferred embodiment according to the present invention mentioned above allows the manufacturing of the insulating casing of the dual type BNC connector to be more practical, to be able to be manufactured in mass production so as to save the production cost.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claim is:

1. A multiple pieces double type BNC connector, comprising an insulating rear section casing and a plurality of insulating front section casings, said rear section casing having an accepting room corresponding to an accepting room of each said front section casing; said accepting room of said rear section casing and said accepting room of said front section casing being respectively combined with a first engaging section and second engaging section of a metal shell; each said metal accepting room being combined with an insulator, said insulator being combined with a BNC terminal, said BNC terminal being not contacted with said metal shell so as to form a structure with at least one set of dual type BNC connectors, wherein said accepting room of said rear section casing and said first engaging section of said metal shell respectively have corresponding cut planes so that a relative rotation is not yielded between both of them.

2. The connector according to claim 1, wherein the rear end of said cut plane of said first engaging section has a flange; said flange is buckled at the outside of the rear end of said accepting room of said rear section casing.

3. The connector according to claim 1, wherein said cut planes of said accepting rooms of said rear section casings of each set of dual type BNC connectors are disposed in reserve.

4. The connector according to claim 1, wherein said accepting room of said front section casing and said second engaging section of said metal shell respectively have corresponding cut planes so that a relative rotation is not yielded between both of them.

5. The connector according to claim 1, wherein a plurality of arc engaging grooves are disposed on the outside of said accepting room at the front end of said rear section casing, arc engaging sections corresponding to said engaging grooves are disposed at the rear end of said front section casing; said engaging groove accepts said engaging section.

6. The connector according to claim 1, wherein a hole and groove are disposed in the wall of said rear section casing; said hole and said groove respectively accept a capacitor and nail; a conductive element is fixed on the outside of said capacitor with said nail; the two ends of said capacitor are respectively connected to said metal shell and said conductive element.

7. The connector according to claim 1, wherein said rear section casing is combined with at least four front section casings.

8. The connector according to claim 1, wherein said rear section casing is combined with at least six front section casings.

9. The connector according to claim 1, wherein said rear section casing is combined with at least eight front section casings.

10. The connector according to claim 1, wherein a plurality of circular engaging grooves are disposed on the outside of said accepting room at the front end of said rear section casing, circular engaging sections corresponding to said engaging grooves are disposed at the rear end of said front section casing; said engaging groove accepts said engaging section.

11. The connector according to claim 1, wherein said engaging groove of said rear section casing and said engaging section of said front section casing respectively have corresponding cut planes so that a relative rotation is not yielded between both of them.

* * * * *